US006823791B1

(12) United States Patent
Richardson, Jr. et al.

(10) Patent No.: US 6,823,791 B1
(45) Date of Patent: Nov. 30, 2004

(54) PLATE INVERTER FOR PLATE MANAGEMENT SYSTEM AND METHOD OF OPERATION

(75) Inventors: Donald B. Richardson, Jr., Atkinson, NH (US); Joseph R. Lyons, Jr., Wilmington, MA (US); Regina A. Cadillac, Westford, MA (US); Steven J. DaSilva, Reading, MA (US)

(73) Assignee: Agfa Corporation, Wilmington, MA (US)

( * ) Notice: Subject to any disclaimer, the term of this patent is extended or adjusted under 35 U.S.C. 154(b) by 0 days.

(21) Appl. No.: 10/649,876

(22) Filed: Aug. 26, 2003

(51) Int. Cl.[7] ..... B65H 3/08

(52) U.S. Cl. ..... 101/477; 101/479; 271/9.07; 271/11; 271/161; 271/105; 414/797

(58) Field of Search ..... 101/477, 401.1, 101/483, 479, 480; 271/9.05, 9.08, 9.11, 105, 107, 186, 11, 104, 106, 161, 162, 164, 170; 414/796.4, 797, 758, 773, 783, 416.03, 416.08

(56) References Cited

U.S. PATENT DOCUMENTS

| | | | | |
|---|---|---|---|---|
| 4,082,455 A | | 4/1978 | Brigham | |
| 4,260,234 A | | 4/1981 | Burton | |
| 5,176,081 A | | 1/1993 | Buus | |
| 5,201,506 A | * | 4/1993 | Kushima et al. | 271/5 |
| 5,560,596 A | * | 10/1996 | Okoda et al. | 271/106 |
| 5,655,452 A | | 8/1997 | Blake et al. | |
| 5,657,692 A | | 8/1997 | Theriault et al. | |
| 5,785,309 A | | 7/1998 | Halup et al. | |
| 5,791,250 A | | 8/1998 | Blake et al. | |
| 5,809,360 A | | 9/1998 | Blake et al. | |
| 6,000,337 A | | 12/1999 | Blake et al. | |
| 6,130,702 A | | 10/2000 | Ganton | |
| 6,341,932 B1 | * | 1/2002 | Otsuji | 414/403 |
| 6,418,849 B1 | * | 7/2002 | Fukui | 101/409 |
| 6,718,875 B2 | * | 4/2004 | Ono | 101/477 |
| 6,776,097 B2 | * | 8/2004 | Takeda | 101/477 |
| 2001/0052220 A1 | | 12/2001 | Usui et al. | |
| 2002/0047234 A1 | | 4/2002 | Ono et al. | |
| 2004/0065221 A1 | * | 4/2004 | Takeda | 101/477 |
| 2004/0139874 A1 | * | 7/2004 | Koizumi et al. | 101/477 |

FOREIGN PATENT DOCUMENTS

EP 0712729 B1 3/1995

* cited by examiner

*Primary Examiner*—Leslie J. Evanisko
(74) *Attorney, Agent, or Firm*—Grant Houston; Robert A. Sabourin

(57) ABSTRACT

A substrate manager for a substrate exposure machine is used, in one example, as a platesetter. As such, it comprises a substrate storage system, containing one or more stacks of substrates, such as plates in one implementation. A substrate picker is provided for picking substrates from the stack of substrates. The substrates are then handed to a transfer system that conveys the substrates to an imaging engine. According to the invention, a substrate inverter system is also provided. This system inverts the substrates from being imaging or emulsion side down to emulsion side up in the present implementation. This allows plates, for example, which are stored emulsion side down in cassettes to be flipped to an emulsion side up orientation, and then transferred, using the substrate transfer system to the imaging engine. This flipping process has two advantages. First, the plates can be emulsion side up during the transfer. This prevents any damage to the sensitive plate emulsions. Moreover, the plates, now in an emulsion side up configuration are in the right orientation for being installed on the outside of a drum on an external drum imaging system, as is common in many platesetters. Also, the plates are picked from the non emulsion side. Thus the system is less sensitive to emulsion formulation changes. A slip sheet capture mechanism is also provided to transfer slip sheets separating the plates to a storage location.

18 Claims, 16 Drawing Sheets

PLATE INVERTER FOR PLATE MANAGEMENT SYSTEM AND METHOD OF OPERATION

BACKGROUND OF THE INVENTION

Imagesetters and platesetters are used to expose substrates that are used in many conventional offset printing systems. Imagesetters are typically used to expose the film that is then used to make the plates for the printing system. Platesetters are used to directly expose the plates.

For example, plates are typically large substrates that have been coated with photosensitive or thermally sensitive material layers, referred to the emulsion. For large run applications, the substrates are fabricated from aluminum, although organic substrates, such as polyester or paper, are also available for smaller runs.

Computer-to-plate printing systems are used to render digitally stored print content onto these printing plates. Typically, a computer system is used to drive an imaging engine of the platesetter. In a common implementation, the plate is fixed to the outside or inside of a drum and then scanned with a modulated laser source in a raster fashion. In other implementations, the plate is held on a flatbed.

The imaging engine selectively exposes the emulsion that is coated on the plates. After this exposure, the emulsion is developed so that, during the printing process, inks will selectively adhere to the plate's surface to transfer the ink to the print medium.

Typically, one of two different strategies is used to feed substrates to the imaging engine in the printing system. In the simplest case, an operator manually places individual substrates into a feeder that then conveys the substrates through a feed port to the drum scanner. This approach, however, has some obvious drawbacks. First, an operator must be dedicated to feeding the substrates. And, the printing system must be housed within a lightsafe environment, if the substrates being used have any sensitivity to ambient light. The alternative approach is to use a substrate manager.

Managers typically house multiple substrate cassettes. Each cassette is capable of holding many substrates in a stack. The substrates are separated by slip sheets that are used to protect the plate emulsions from damage. For example, in one common implementation, each cassette holds up to one hundred substrates. The manager selects substrates from one of its cassettes and then feeds the substrates, automatically, into the imaging engine, while removing the slip sheets.

In these designs, cassettes are loaded into the manager on a table. The table is then raised and lowered inside the manager to bring the substrates of a selected cassette into cooperation with a picker that grabs individual substrates and feeds them to the imaging engine.

SUMMARY OF THE INVENTION

The present invention is directed to a substrate manager for a substrate exposure machine. One example of such a machine would be a platesetter. As such, it comprises a substrate storage system, containing one or more stacks of substrates, such as plates in one implementation. A substrate picker is provided for picking substrates from the stack of substrates. The substrates are then handed to a transfer system that conveys the substrates to an imaging engine.

According to the invention, a substrate inverter system is also provided. This system inverts the substrates from being emulsion side down to emulsion side up in the present implementation. This allows plates, for example, which are stored emulsion side down in storage devices such as cassettes, to be inverted to an emulsion side up orientation, and then transferred, using the substrate transfer system to the imaging engine. This prevents damage to the emulsion on the plates, which can be very sensitive to any surface contact.

This inverting process has some advantages. First, the plates can be picked from the non-emission side so that the picker's suction cups will not mar the emulsion. Further, the plates are emulsion side up during the transfer. This further prevents any damage to the sensitive plate emulsions. Moreover, the plates, now in an emulsion side up configuration, are in the right orientation for being installed on the outside periphery of a drum on an external drum imaging system, as is common in many platesetters.

In specific embodiments, the substrate storage system is capable of containing multiple cassettes, each holding separate stacks of substrates. The substrate picker includes a substrate peeler for separating a substrate from the stack of substrates. A sheet separator is also provided to ensure that a sheet separating the substrates, typically used to protect the plate emulsions, is separated from the substrate that is being picked by the substrate picker.

In the preferred embodiment, the substrate inverter system comprises an arcuate transfer path over which substrates are carried to invert the substrates and transfer the substrates between the substrate storage system and the substrate transfer system.

In the current implementation, the substrate inverter system specifically comprises an advancing or leading arm and a trailing, or lagging, arm for carrying the substrates over the arcuate transfer path. The leading arm carries headers of the substrates and the lagging arm carries lagging edges.

In other embodiments a curved conveyor system is used, for example.

In general, according to another aspect, the invention features a plate inverter for a platesetter system. The plate inverter comprises a plate picker for picking a plate and an arcuate transfer path, over which the plate is conveyed between the plate picker and an imaging engine.

In general, according to still another aspect, the invention features a method of managing substrates in a substrate exposure machine. This method comprises storing substrates to be exposed in a stack of substrates and then picking the substrates from this stack. The substrates are subsequently inverted and then conveyed, after being inverted, to an imaging engine.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Plate manager

Figure 1:
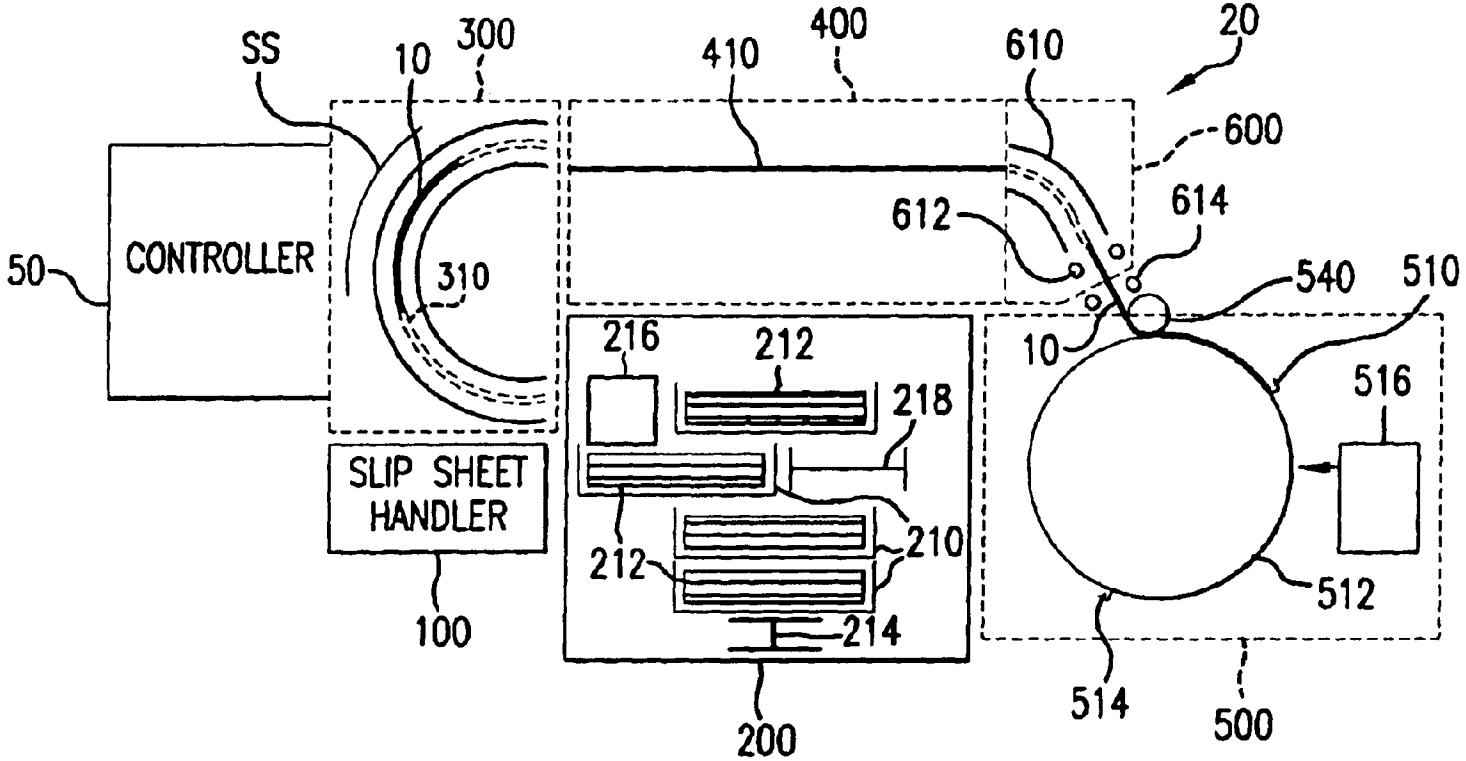
FIG. 1 is a schematic side plan view of a plate manager according to the present invention.

FIG. 1 shows a substrate, and more specifically a plate, manager 20, which has been constructed according to the principles of the present invention.

Generally, the plate manager 20 comprises a plate store 200, a plate inverter system 300, a plate transfer system 400, and a plate inserter 600, all of which are controlled by a system controller 50. A plate imaging engine 500 is further provided to expose the substrates.

The plate store system 200 comprises, when loaded, multiple cassettes 210. Each of these cassettes 210 holds a stack of plates 212. The cassettes are moved vertically within the plate store system 200 by a cassette elevator or lifter 214.

In one example, the cassettes themselves are stacked atop one another, or in stacks of cassettes, that are moved vertically by the cassette elevator 214 so that the stack of plates 212 of a specific cassette 210 is raised to the level of a plate picker system 216. Once the cassette 212 is at the proper height, a cassette translator 218 moves it laterally. The cassette 212 is thereby positioned underneath the plate picker system 216, which then picks a plate off of the stack of plates 212.

The plate picker or peeler system 216 provides individual plates from the stack of plates 212 to the plate inverter system 300. The plate inverter system 300, in the preferred embodiment, comprises an arcuate transfer path 310 over which the plates are conveyed to effect the inversion.

Simultaneously with the picking of the plate 10 and its transfer across the transfer path 310, a slip sheet handler 100 captures a slip sheet SS, that is typically located between the individual plates in the stack of plates 212 and subsequently transfers the slip sheet SS with the plate 10 over the transfer path 310. Typically, the slip sheet handler 100 then passes the slip sheets off for storage.

In the present embodiment, the cassettes 210 are as described in U.S. application Ser. No. 10/117,749, filed on Apr. 5, 2002, entitled Plate Cassette for Platesetter, by DaSilva, et al., which is incorporated herein by this reference in its entirety. This cassette system has a second, slightly wider slip-sheet removal groove that extends laterally across the cassette's tray between a leak groove and a registration guide. This groove is a depressed portion or recess in the otherwise planar surface of the cassette's tray. It is used to facilitate the removal of slip sheets for small plates.

Further, in the present embodiment, the plates 212 are held in the cassettes 210 in a center justified configuration. And, the plates are transferred through the plate manager 20, center justified. However, in other implementations, the plates can be edge justified in both the cassettes and during transfer through the machine.

The plate inverter system 300 transfers the plate 10 over the arcuate transfer path 310 from the plate picker or peeler system 216 of the plate storage system 200 to the plate transfer system 400. This transfer system 400, in the present implementation, comprises a conveyer 410 that receives the plate 10 and then moves the plate 10 laterally in the plate manager 20 toward the plate imaging engine 500.

Between the plate imaging engine 500 and the transfer system 400 is a plate inserter system 600. The angle of the plate is moved from generally a horizontal orientation as it is received from the transfer system 400 to a more vertical orientation for insertion into the plate imaging engine 500. Specifically, the plate is angled at 75 degrees from horizontal for insertion into the engine.

The plate inserter system 600 comprises an inserter transfer path 610. It moves the plate from its horizontal position as it is transferred across the conveyer 410 to a more vertical orientation. It transfers the plate 10 so that it is received by a first set of output pinch rollers 612, and transferred to a second set of pinch rollers 614.

The plate imaging engine 500 receives the plate 10 from the plate inserter system 600. The plate is brought into engagement with a header clip 510 on the exterior of drum 512 of the imaging engine 500. The drum 512 is then advanced so that the plate 10 is progressively installed on the outside perimeter of the drum 512 by ironing roller 540 until its lagging edge is engaged by a lagging edge clip 514.

At this stage, the plate 10 is selectively exposed by a laser scanning system 516. Typically, this is a high speed, high power laser scanning system that selectively exposes the emulsion on the plate 10 with the desired image, in a raster fashion. Afterward, the plate 10 is typically ejected from the plate imaging engine 500 for development and further processing. For example, in one configuration, the exposed plate is ejected to a conveyor system, not shown, and transported to a plate processor.

Plate Inverter System

Figure 2:
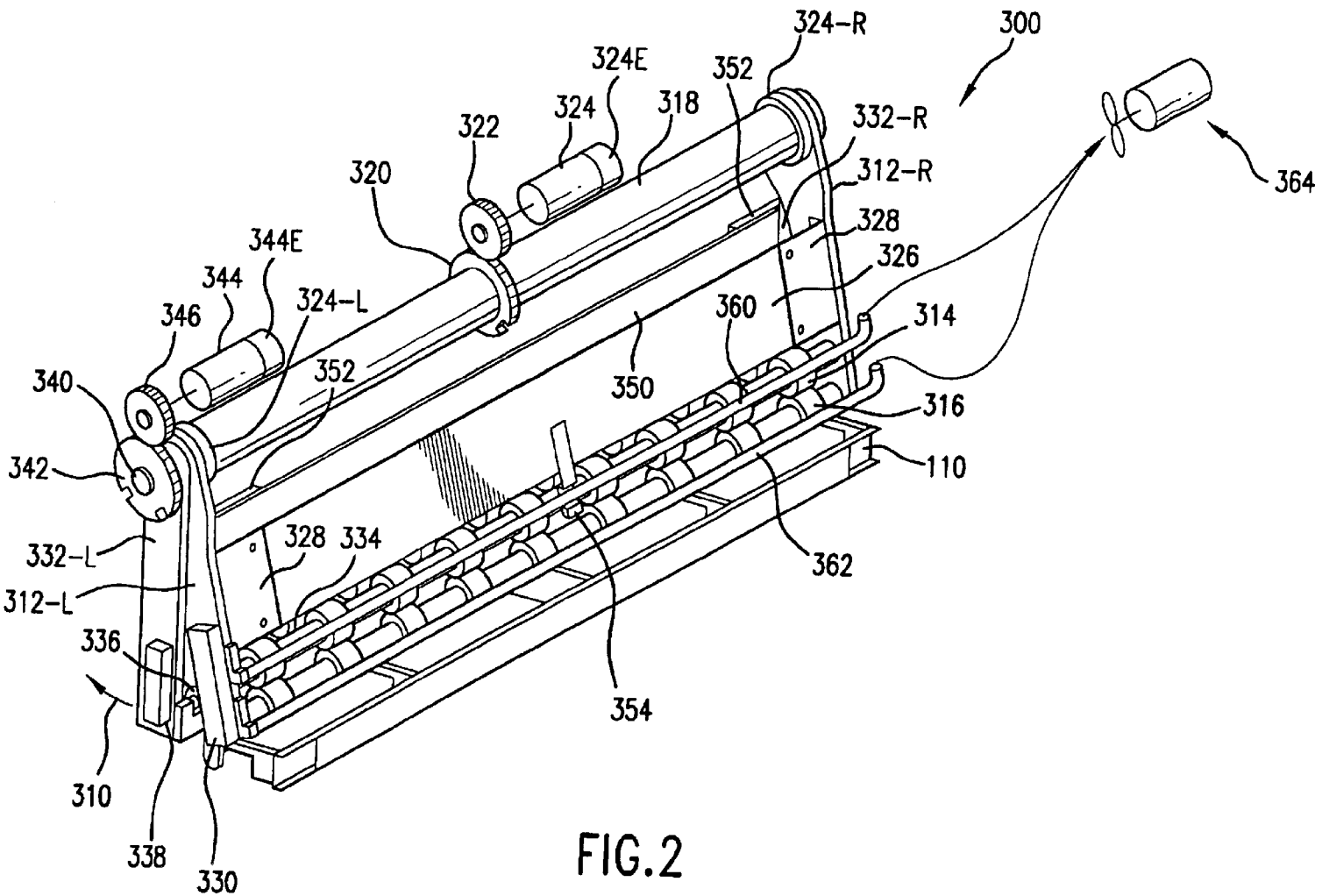
FIG. 2 is a perspective view of a plate inverter and slip sheet capture system, according to the present invention, in a home position.

FIG. 2 shows the present embodiment of the plate inverter system 300. It generally comprises a left lagging arm 312-L and a right lagging arm 312-R The right and left lagging is arms 312-R, 312-L support lagging arm nip rollers 314 and 316. These lagging arm nip rollers 314, 316 extend between the right and left lagging arms, parallel to each other, to thereby define a nip between the first lagging arm nip roller 314 and the second lagging arm roller 316.

Also, a support plate 326 is typically required. It extends between the right lagging arm 312-R and the left lagging arm 312-L, being connected to the lagging arms via L brackets 328. This increases the rigidity of the system of lagging arms 312.

The right and left lagging arms 312-R, 312-L are in turn supported by a hollow axle 318. Right and left flanges 324-R, 324L are secured to the ends of the hollow lagging arm axle 318. The right lagging arm 312-R is bolted to the right axle flange 324-R and the left lagging arm 312-L is bolted to the left axle flange 324-L such that the lagging arms 312 are secured to the lagging arm hollow axle 318.

In the specific implementation, a lagging arm gear 320 is disposed near the center of the lagging arm's hollow axle 318. It engages a drive gear 322 of a lagging arm drive motor 324. As a result, by driving the lagging arm motor 324, the lagging arm hollow axle 318 is rotated to thereby allow the lagging arms 312-R, 312-L to traverse the arcuate transfer path 310. The drive motor 324 has an integral brake and an encoder 324*e*. This allows the motor 324 to hold the position of the arms 312 and also move the arms 312 through predetermined arcs under control of the system controller 50.

The lagging arms 312 additionally support a lagging arm nip actuation and roller drive mechanism 330, which allows the controlled separation of the first lagging arm nip roller 314 from the second lagging arm nip roller 316 and the driving of the nip rollers to feed a plate in the nip. The mechanism further has a motor encoder for measuring the number of rotations of the rollers 314, 316. This opens the nip between these two rollers enabling insertion of a plate or other substrate into the opened nip. Thereafter, the lagging arm nip actuation mechanism 330 closes the nip between the lagging arm nip rollers 314, 316 to thereby engage the plate.

The plate inverter system 300 also includes right and left leading arms 332-R, 332-L. The leading arms 332-R, 332-L similarly support first and second leading arm nip rollers 334, 336. A leading arm nip actuation mechanism 338 is provided on each of the right leading arm 332-R and the left leading arm 332-L to control the opening and closing of the nip between the first leading arm nip roller 334 and the second leading arm nip roller 336. In this way, the rollers on the leading arms 332 can thereby be opened and closed to release and engage a plate between nip rollers 334 and 336.

The right and left leading arms 332-R, 332-L are supported on a solid leading arm axle 340. This axle includes a leading arm gear 342, which is engaged by a leading arm motor 344 via a leading arm drive gear 346. In this way, when the leading arm motor 344 is driven, the right and left leading arms 332-R, 332-L are rotated so that the nip of the leading arm nip rollers 334, 336 moves through the arcuate transfer path 310 of the plate inverter system 300. The leading arm motor 344 also has an integral brake and an encoder 344*e*. A leading arm support member 350 is also provided. It extends between the right leading arm 332-R and the left leading arm 332-L. It is secured to the leading arms via L brackets 352. It similarly increases the rigidity of the leading arm system.

A plate lagging edge detector 354 is provided on the lagging arm system. Specifically, it is attached to the lagging arm support member 326. It projects down near a plane that extends between the nip of the first lagging arm nip roller 314 and the second lagging arm nip roller 316. In the preferred implementation, it detects the level of reflected light. As a result, it can detect whether a reflective substrate, such as a plate, is being held in the nip of the lagging arm nip rollers 314, 316. This arrangement for detecting the plate requires that the plate surface opposite the detector be reflective, which is a characteristic of the non-emulsion side of the plate.

Supported by the leading arms 332 is a slip sheet capture mechanism 110 of the slip sheet handler 100. This is used to grab the slip sheet that is underneath a plate that is being held between the nip rollers of the lagging arms.

Figure 3:
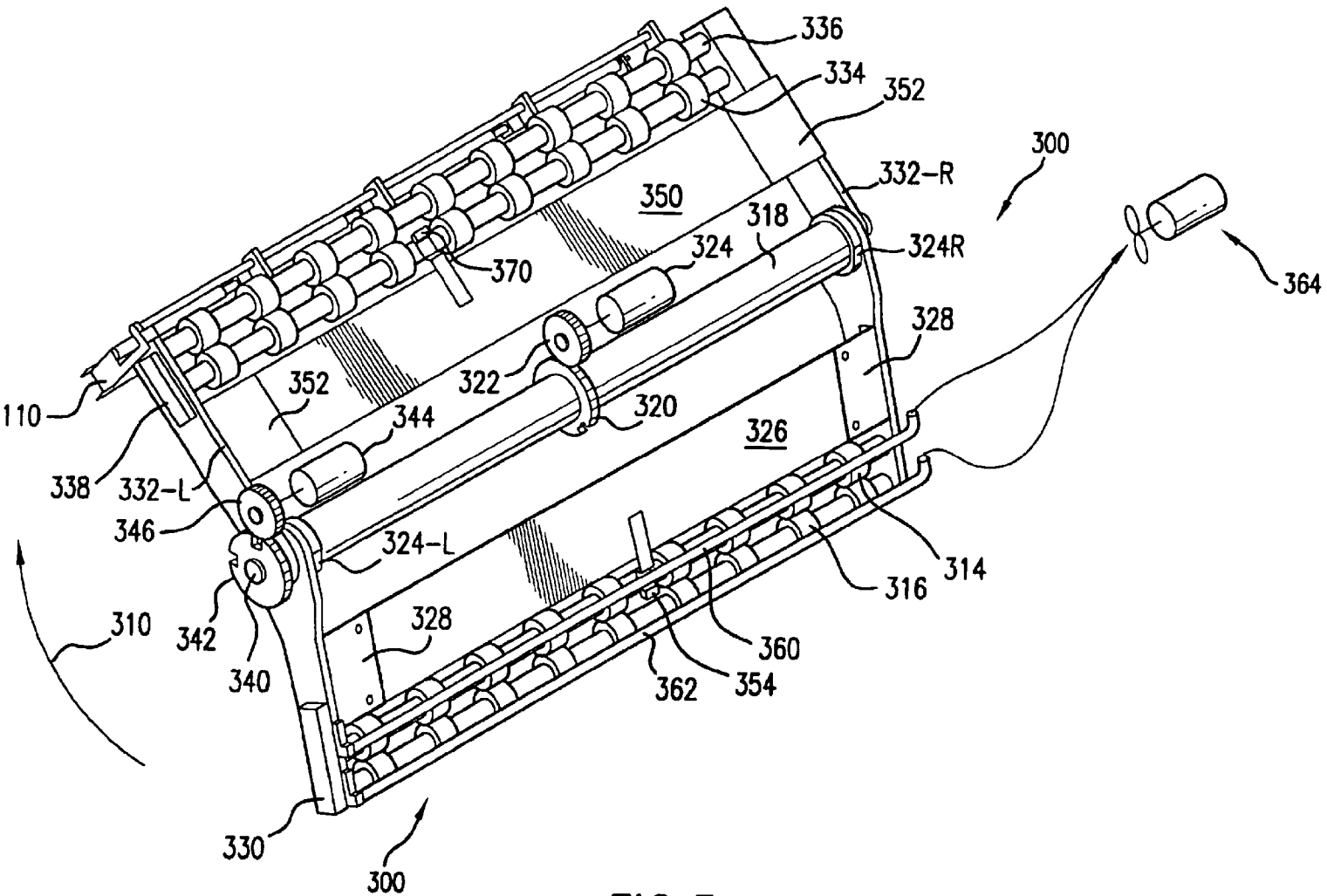
FIG. 3 is a perspective view of the inventive plate inverter system in a plate feeding, or intermediate, position.

FIG. 3 shows the plate inverter system 300 in a feed or intermediate position. Specifically, the leading arm motor 344 has been driven to rotate the right leading arm 332-R and the left leading arm 332-L upward along the arcuate transfer path 310. This view better shows the first leading arm nip roller 334 and the second leading arm nip roller 336.

Also shown is a plate header detector 370. It detects the presence of a plate that is held between the leading arm nip rollers 334, 336 by detecting the plate's reflective non-emulsion surface as in the case of the lagging edge detector 354.

The lagging arms 312-R, 312-L further carry a first or upper air bar 360 and a second or lower air bar 362, in one embodiment. These are connected to a compressor system 364, which provides compressed air to the first air bar 360 and the second air bar 362 of the lagging arm system to facilitate the separation of slip sheets from the plates, under the control of the system controller 50.

Slip Sheet Capture Mechanism

Figure 4:
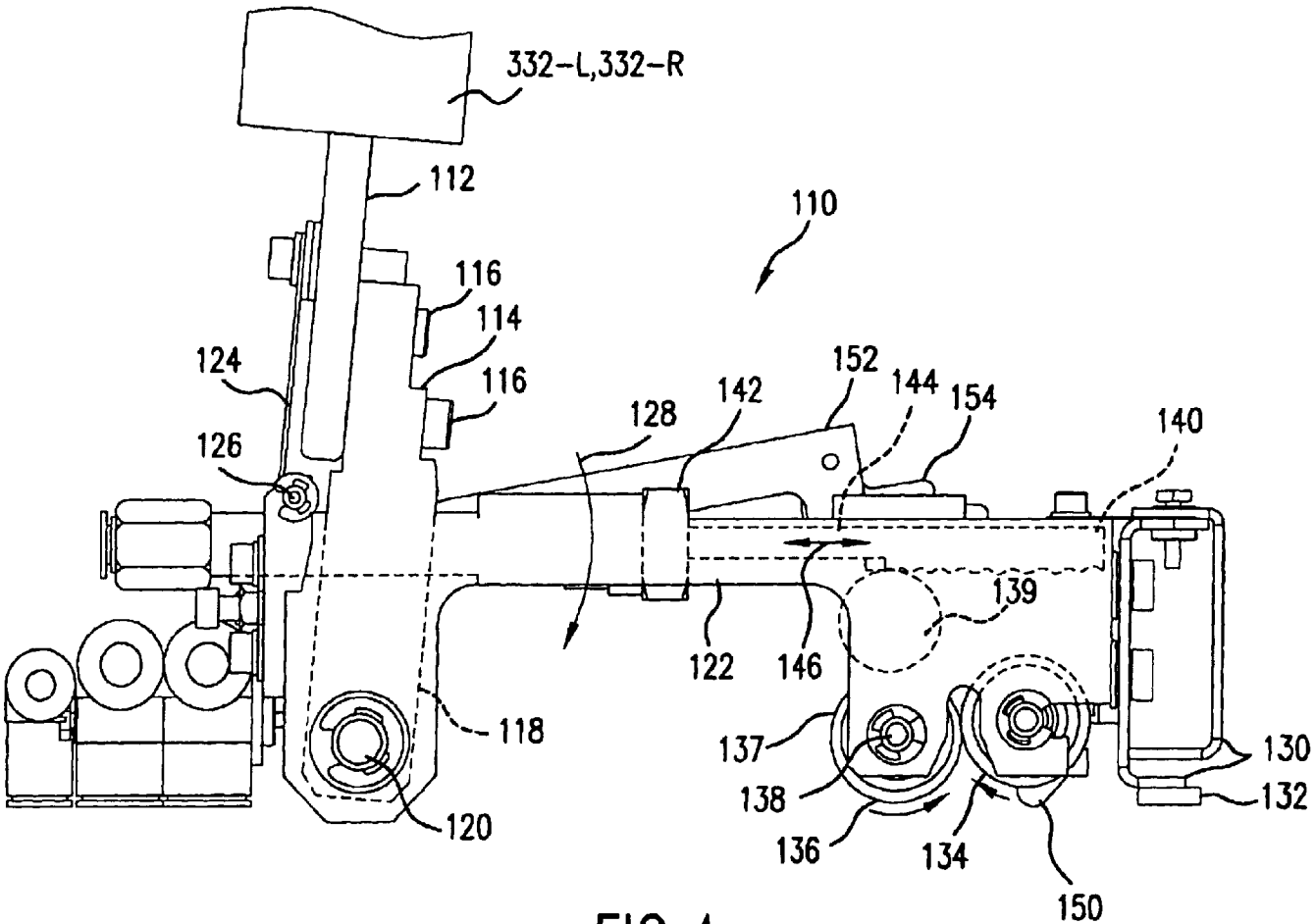
FIG. 4 is a side plan view of a slip sheet capture mechanism, according to the present invention.

FIG. 4 shows the slip sheet capture mechanism 110. Specifically, it comprises a first member 112 that is rigidly connected to the right and left leading arms 332-L, 332-R. A series of second members 114 are bolted to the first member 112 via bolts 116. A distal end 118 of the second member 114 has a bore through which a shaft 120 extends. The shaft 120 similarly extends through a pivot frame member 122. As a result, the pivot frame member 122 can rotate with respect to the second frame members 114. A spring member 124 is bolted to the first member 112 and spring loaded to a pivot point 126 of the pivot frame member 122. This resiliently biases the pivot frame member 122 relative to the first member 112 to rotate about shaft 120 in the direction of arrow 128.

The slip sheet capture mechanism 111 engages a slip sheet via three components. Specifically, the slip sheet capture mechanism has a foot frame 130 that is bolted to the end of the pivot frame member 122. The foot frame 130 supports a foot pad 132 for holding a slip sheet. The mechanism 111 further comprises a drive slip sheet roller 136 that is journaled to rotate on the pivot frame 122 via axle 138 and a slip sheet follower roller 134 that is similarly journaled to rotate relative to the pivot frame 122 that supports it. The drive nip roller 136 includes a gear 137 that engages an intermediate gear 139, which is also journaled to rotate on the pivot frame 122. The gear 139 is engaged by a rack 140 that is connected to the actuation shaft 144 of a double acting air cylinder 142. As a result, actuation of the air cylinder 142 moves the shaft 144 in the direction of arrow 146 to move the rack 140 in both the right and left directions in the orientation of FIG. 4. This rotates the intermediate gear 139, and in turn, the nip drive slip sheet roller, 136.

Slip sheet detector probes 150 are further provided on the pivot frame 128. They extend below the outer periphery of the follower roller 134 to verify the presence or not of a slip sheet. Generally conductivity is detected between the probes. A slip sheet will be non-conductive yielding a very high resistance between the probes 150. A plate will be conductive resulting in a low resistance.

Figure 5:
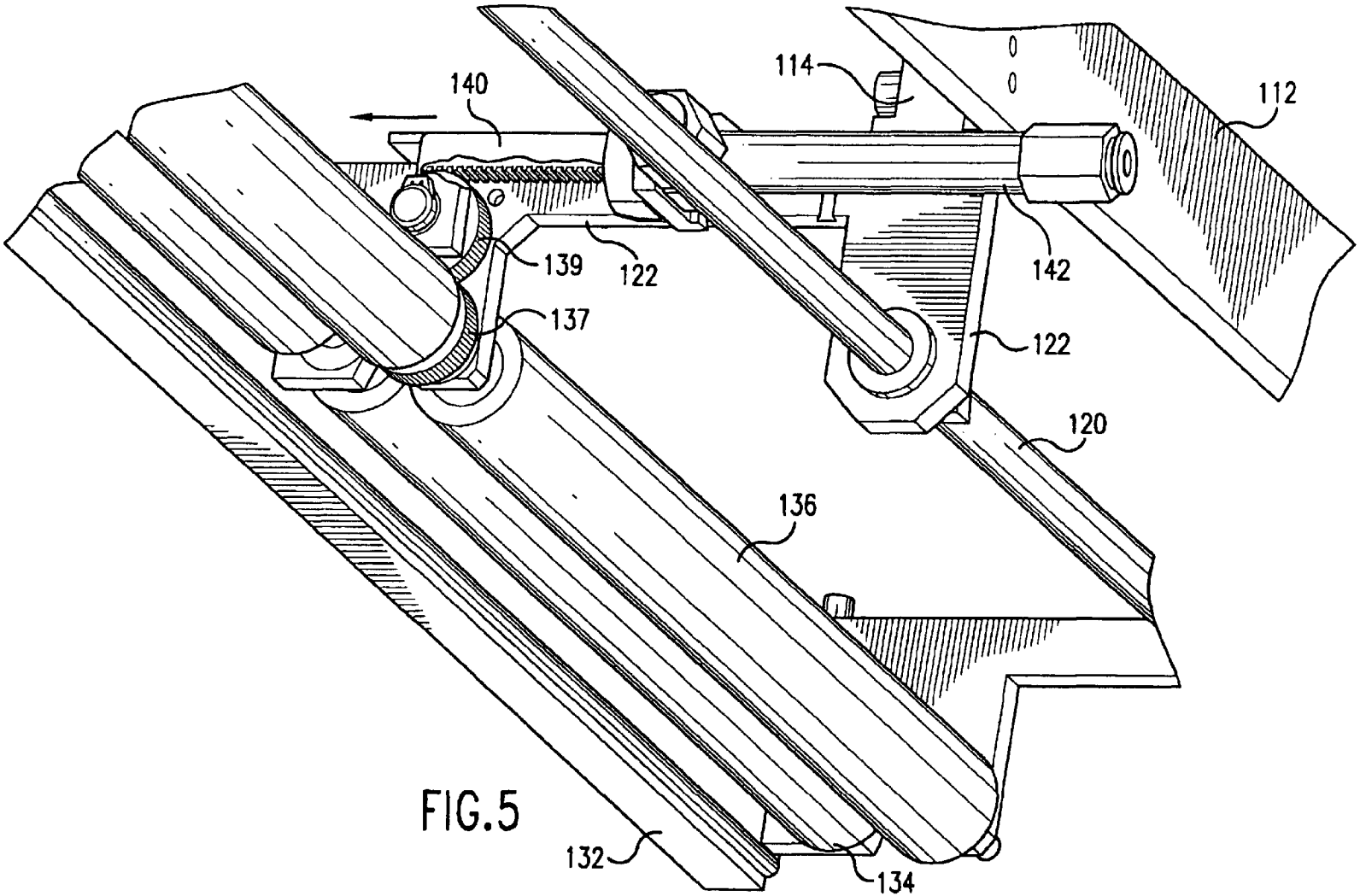
FIG. 5 is a perspective view of a bottom of the slip sheet capture mechanism showing its actuation mechanism, according to the present invention.

FIG. 5 better shows the arrangement of the double acting air cylinder 142 and its rack 140. It rotates gear 139 to in turn drive the drive roller 136 via its drive roller gear 137. It allows the selective rotation of the drive roller 136.

Figure 6:
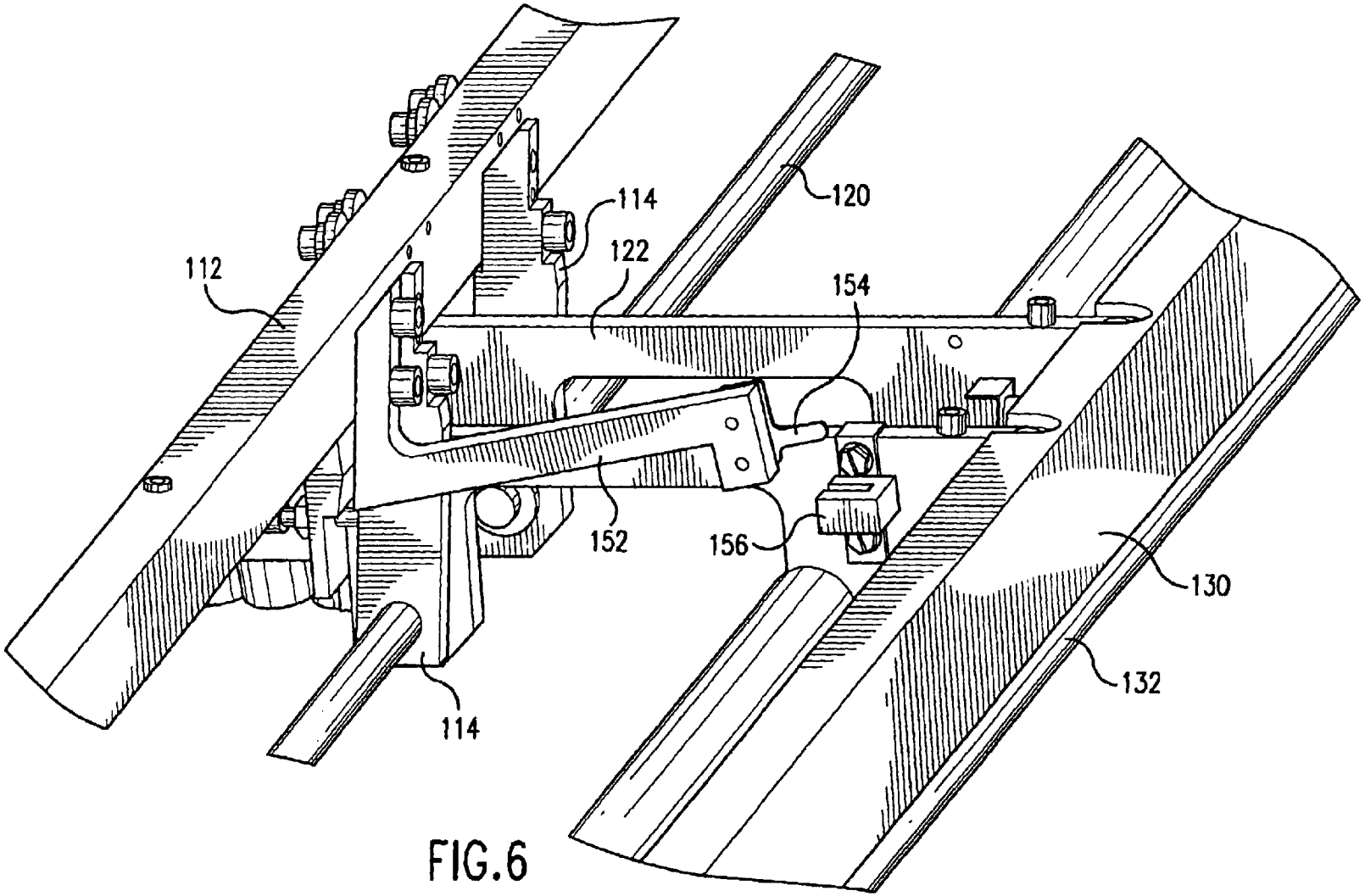
FIG. 6 is a top perspective view of the slip sheet capture mechanism showing a pivot detector, according to the present invention.

FIG. 6 shows a system for detecting the degree to which the pivot frame 122 is pivoting with respect to the first member 112. Specifically, a flag arm 152 is provided, which is bolted to the first member 112. It comprises a flag portion 154 that passes in proximity to a sensor 156. As a result, the pivoting of the pivot frame 122 can thereby be detected by this detector 156 and specifically when the pivot frame 122 has rotated a predetermined amount such that the flag portion 154 is within the slot of the U-shaped element of the sensor 156.

Plate Inversion and Slip Sheet Capture Method

Figure 7A:
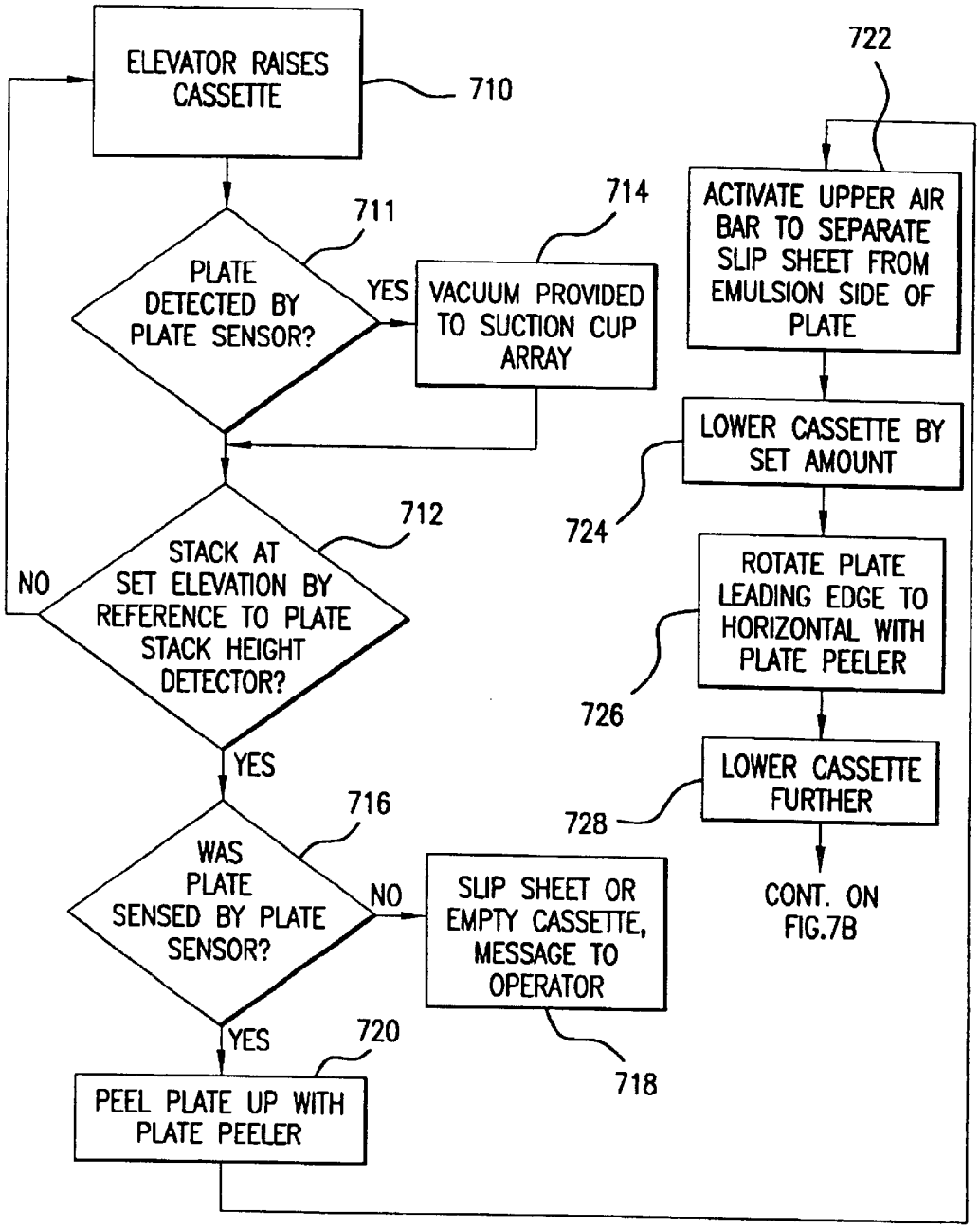
FIGS. 7A, 7B, and 7C are flow diagrams illustrating a method for plate capture and inversion and slip sheet capture according to the present invention.
Figure 7B:
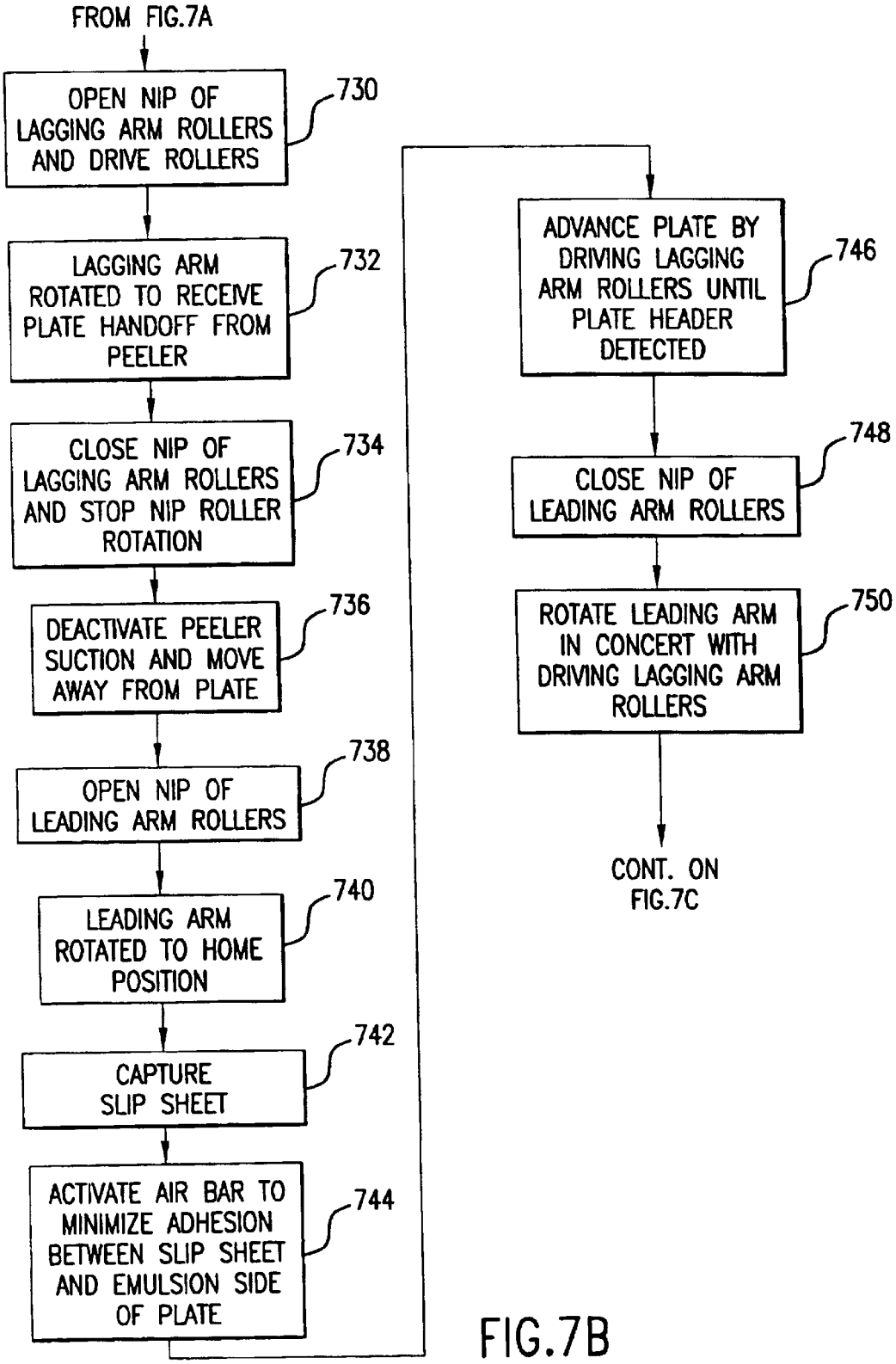
Figure 7C:
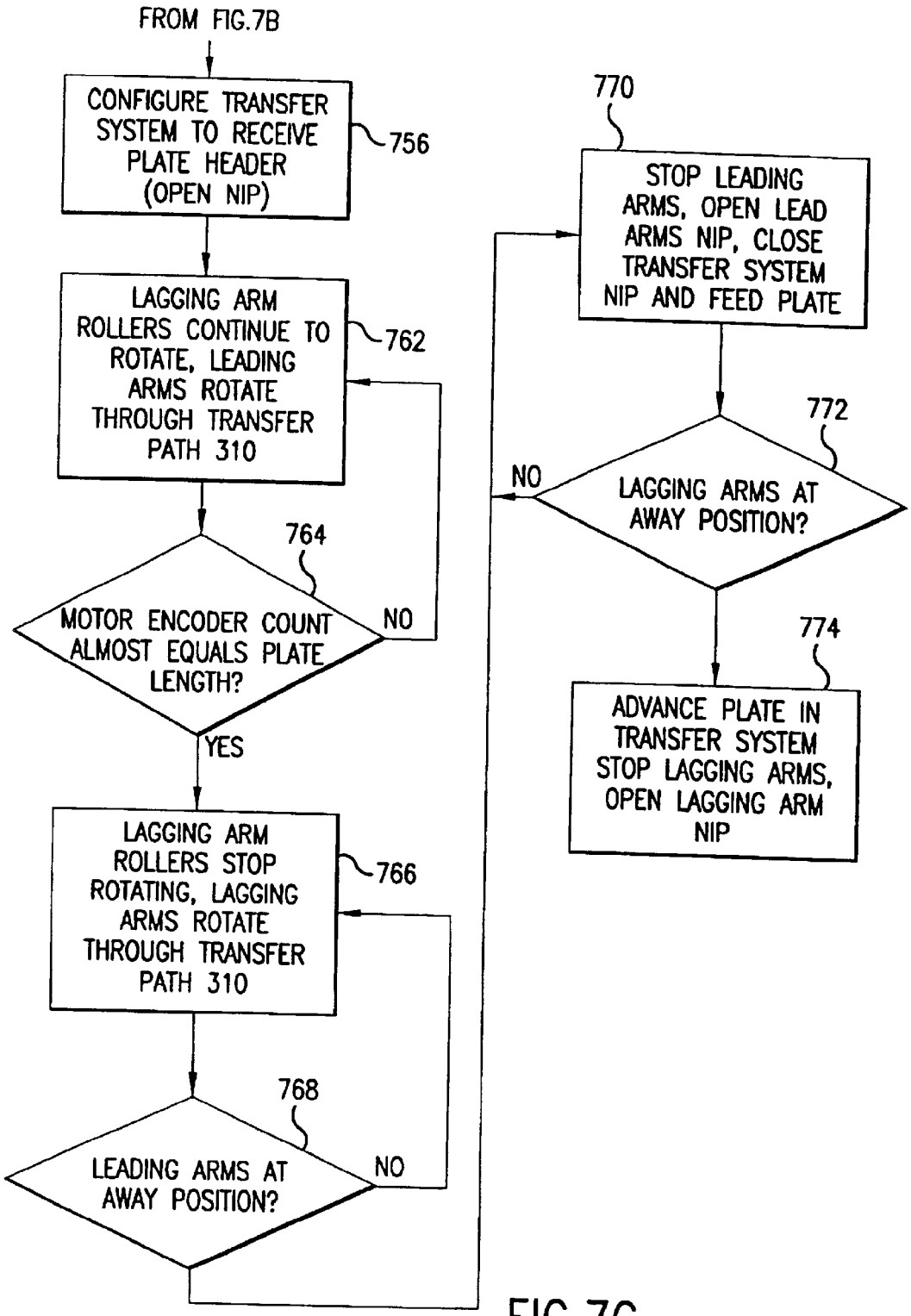

FIGS. 7A–7C are flow diagrams that are used to describe the operation orchestrated by the system controller 50 of the preferred embodiment of the plate inverter 300. These flow diagrams are described with reference to FIGS. 8A–8F, which show the plate inverter system 300 at various stages of operation in the inversion of the plate according to the invention.

In more detail, with reference to step 710 of FIG. 7A, in the first phase of the operation, the cassette elevator 214 raises the cassette 210. The cassette is also horizontally moved via the cassette translator 218. Simultaneously with the raising of the desired cassette 210, the leading arms 332 and the lagging arms 312 are moved out of the home position to provide clearance for the cassette's movement.

Figure 8A:
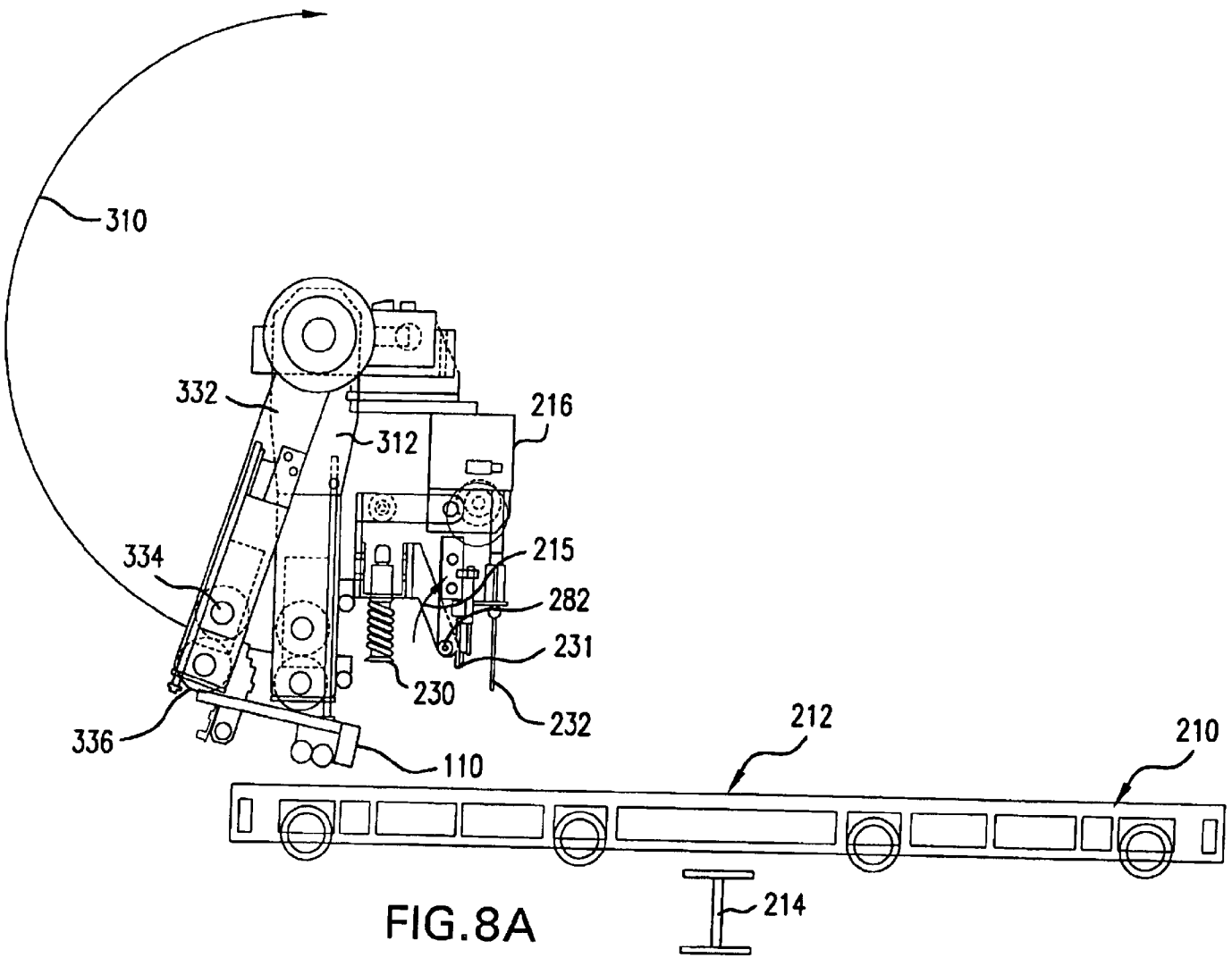
FIGS. 8A, 8B, 8C, 8D, 8E, and 8F are side plan views of the plate inverter system and slip sheet capture mechanism during various phases of operation.
Figure 8B:
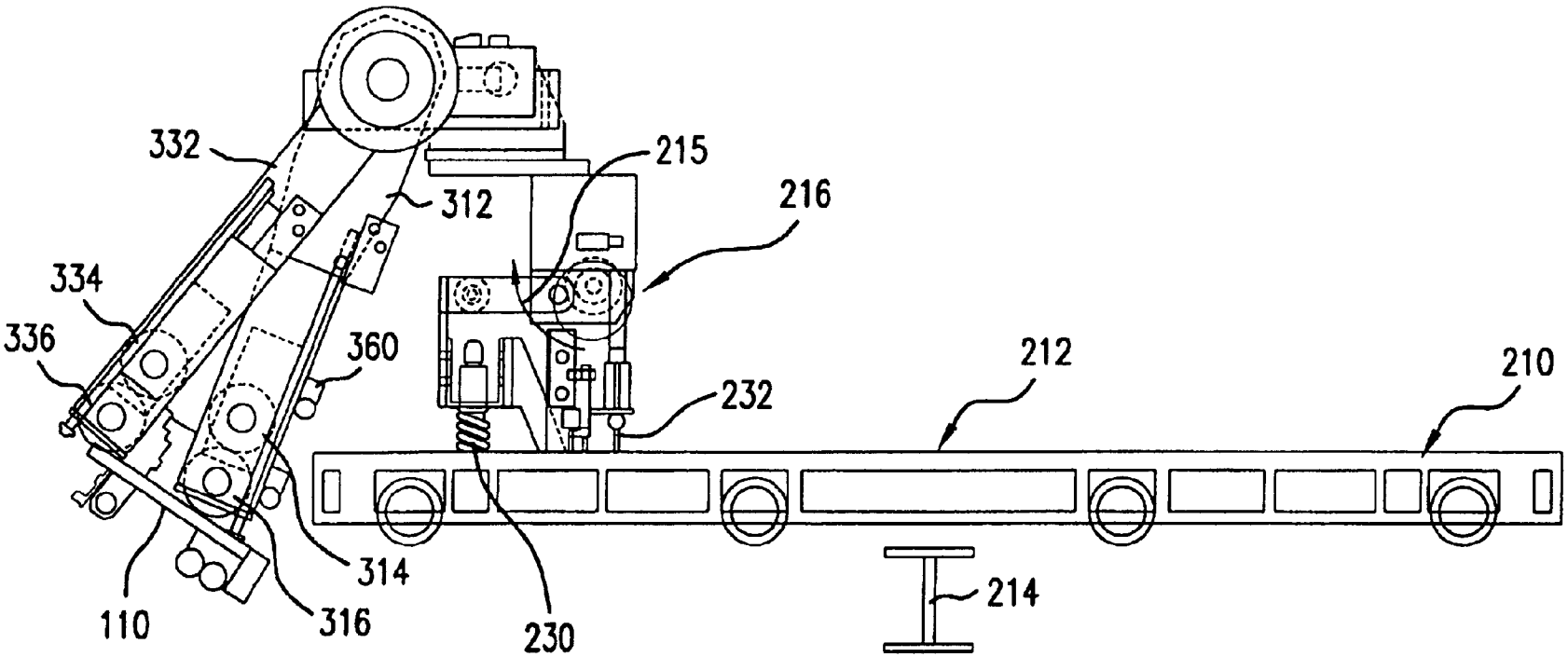

FIGS. 8A and 8B illustrate the operation of step 710. Specifically, in FIG. 8A, the leading arms 332 and the lagging arms 312 are in the home position. However, as illustrated in FIG. 8B, for the cassette 210 to be raised by the elevator 214, both the leading arms 332 and the lagging arms 312 move to provide clearance for the cassette 210. This brings the top plate in the stack of plates 212 in the cassette 210 into engagement with the peeler mechanism 216. The peeler mechanism 216 includes an array of suction cups 230 that are brought into engagement with the top plate in the plate stack 212.

The height to which the cassette 210 is raised by elevator 214 is controlled by feedback from sensor probe 232 that functions as a plate stack height detector. It engages or contacts and thus detects the top plate to thereby control the height of the plate/cassette such that the suction cups 230 can engage the top plate. It should be noted that since the stack 212 in the cassette 210 can contain a variable number of plates, the elevator could not simply raise the cassette 210 to a fixed height, thus leading to the requirement of the stack height detector 232. Also provided is a pair of conductive springs 231 that make contact with the non-emulsion side of the plate. The springs 231 are compliant so as to not damage the non-emulsion side of the plate. The electrical continuity between the springs 231 signifies whether a plate is present. This conductivity test determines whether it is in contact with a plate. Plates are typically metal and therefore conductive, whereas a slip sheet or the bottom of the cassette is non-conductive.

As the elevator raises the cassette, the plate sensor 231 detects the presence of a plate. When a plate is detected, in step 711, vacuum is provided to the suction cup array 230 in step 714 to engage with the plate. The elevator 214 continues to raise the cassette until the plate stack height detector 232 detects the plate stack at the proper height in step 712 and to ensure plate contact with suction cups.

In step 716, it is determined whether a plate is detected. If the conductive springs 231 do not detect a plate before the sensor probe 232 activates the plate stack height detector, this indicates that contact has been made with a non-conductive surface. This implies that cardboard at the bottom of the cassette or the cassette bottom has been detected, and the cassette is empty of plates, as determined in step 718. Alternatively, it may also indicate that a slip sheet is present, which would lead to an error condition or the activation of the slip sheet removal system to remove the slip sheet.

In contrast, if a plate is detected, the plate is peeled up by the action of the suction cup array 230 pivoting around pivot point 282 in the clockwise direction of arrow 215 in step 720 (see FIG. 8A). During this peeling of the top plate in step 720, pressurized air is also provided to the first air bar 360 in step 722. The air bar has a series of holes spaced along the length and is rotationally aligned to optimize the direction of air flow to separate the slip sheet from the emulsion side or the bottom of the peeled plate. This action is illustrated in FIG. 8B. However, activation of the air bar can be avoided in situations in which slip sheet-plate separation occurs predictably without such facilitation.

Figure 8C:
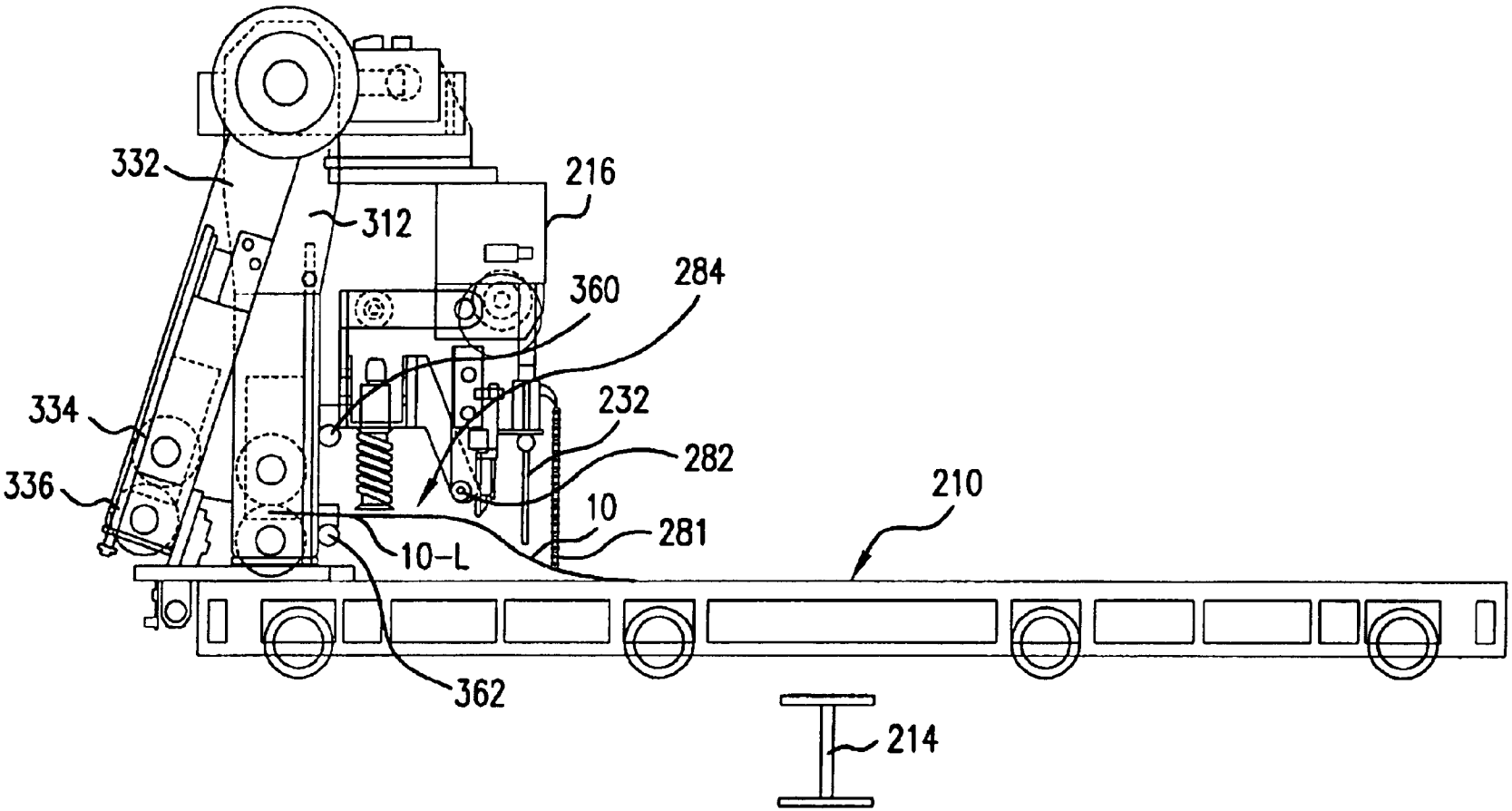

Next, in step 724, the cassette 210 is lowered by the elevator 214. Tho peeler mechanism 216 rotates about pivot point 282 in the counterclockwise direction, see arrow 284, in FIG. 8C. The leading edge: 10L of the plate 10 is thereby moved to a horizontal position in step 726. The cassette is lowcord another set or predetermined amount in step 728 to provide clearance to the leading and lagging arms. The leading arm 332 and the lagging arm 312 begin to be rotated back to their home position as shown in FIG. 8C. The lagging arm nip actuator mechanism 330 is also as claimed in step 730 so that the nip between the first and second lagging arm rollers. 314, 316 is opened. The lagging arm 312 arc then rotated fully to the home position to receive the plate 10, which is being handed off from the peeler 216, in step 732. The lagging arm drive roller 314 is rotated to aid in the introduction of the plate leading edge into the nip of the roller 314,316.

The configuration is shown in FIG. 8C. The plate header 10-L is being held up by the suction cup array 230 so that the header extends into the nip between nip rollers 314, 316.

Also shown is a flexible electrostatic discharge member 281 that makes electrical contact with the non-emulsion side of the plate. The member 281 is connected to electrical ground. In the preferred embodiment, member 281 is a chain. This discharges any electrostatic charge on the plate 10.

In step 734, the lagging arm nip actuation mechanism 330 is activated to close the nip between the first and second nip rollers 314, 316 of the lagging arms 312 and the lagging drive roller 314 rotation is stopped.

At this stage, the leading edge 10-L has been handed off to the lagging arm nip rollers 314, 316. As a result, in step 736, the vacuum to the suction cup array 230 is removed and the peeler mechanism 216 rotates out of engagement with the plate 10. Next, in step 738, the leading arm nip actuation mechanism 338 is activated to open the nip between the first and second leading arm nip rollers 334, 336. The leading arms 332 are then rotated to the home position in step 740.

Next in step 742, the slip sheet is captured.

Figure 8D:
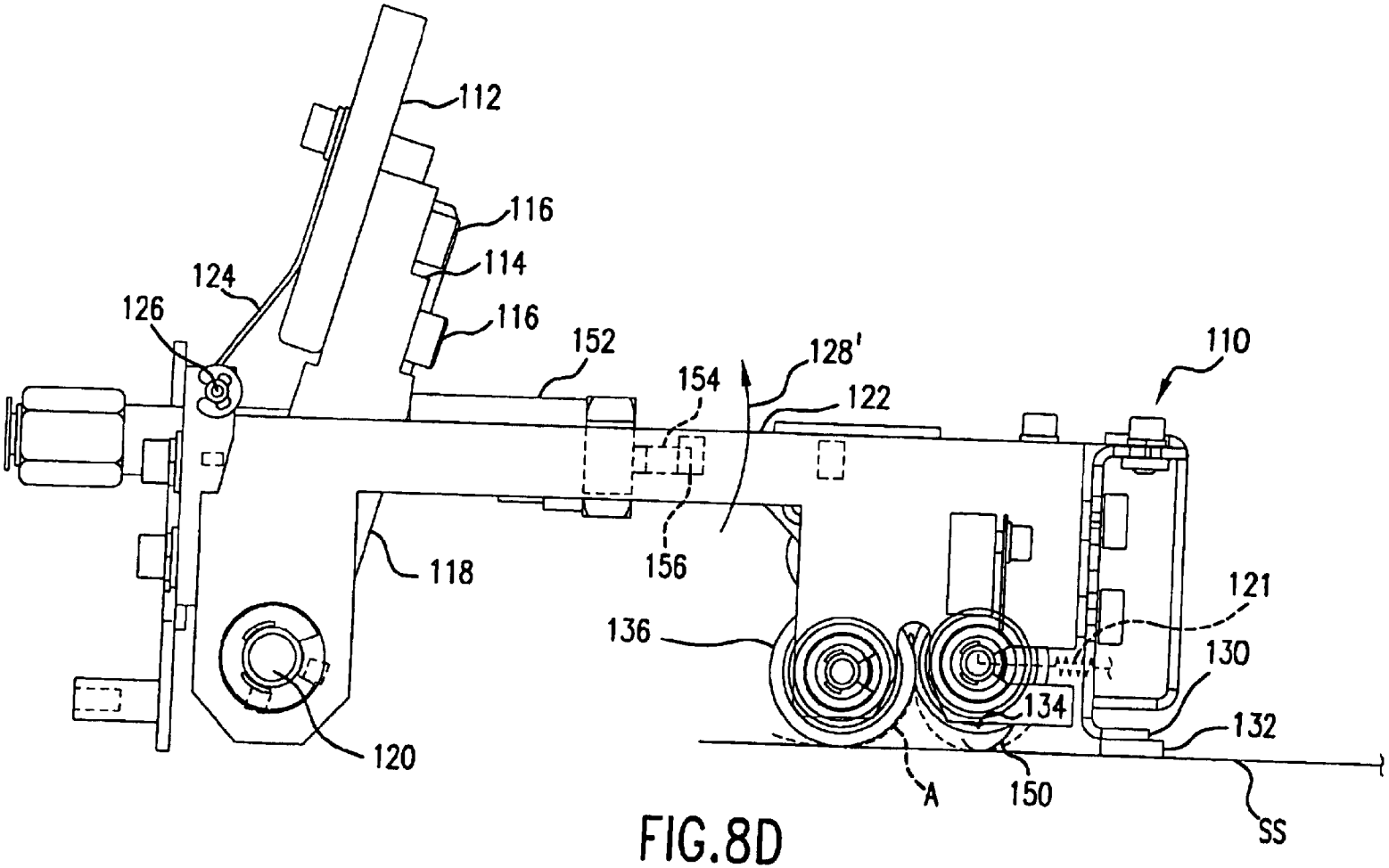

FIG. 8D shows the process for capturing the slip sheet SS. With the plate held between the nip rollers of the lagging arms, 312 and the leading arms 332 in the home position, the elevator 214 is activated to raise the cassette so that the slip sheet SS comes into contact with the slip sheet mechanism 110, and specifically, the foot pad 132.

The raising of the cassette 210 by the elevator 214 causes the top slip sheet to engage the foot pad 132 of the foot 130. Continued rising of the cassette by the elevator causes the pivot frame 122 to rotate in the direction of arrow 128' around shaft 120. This causes the stationary interrupt flag 154 of the rotating flag arm 152 to be detected by the elevation control sensor 156, which is attached to the pivot frame 122 is best illustrated in FIG. 6. When sensor 156 is activated, the elevator 214 is controlled to cease to raise the cassette 210 by the controller 50. In this configuration, shown in FIG. 8D, the pivot frame 122 is biasing the foot pad 132 against the top slip sheet SS, pinning it against the stack of plates beneath the slip sheet in the cassette. The drive roller 136 is also in contact with the slip sheet SS, but the follower roller 134 does not contact the slip sheet in the cassette.

Further, the pair of compliant conductive springs 150 are used to determine whether a slip sheet or plate is present under the slip sheet capture mechanism 110. If they make contact with a conductive surface, electrical continuity between the springs is detected and a plate is determined to be present. A slip sheet will in contrast be an electrical insulator. Thus, the springs can sense if a plate is present when a slip sheet is expected. If at any time prior to activation of sensor 156, the springs 150 detect continuity, the elevator stops raising the cassette and the process continues without a further effort to capture the slip sheet.

At this stage, if a slip sheet is detected, the slip sheet capture mechanism is activated. The double acting air cylinder 142 is activated by a solenoid to move the rack 140 to rotate gear 139. Gear 139 is meshed with gear 137 which is attached to roller 136. Thus, the limited motion of rack 140 in turn rotates roller 136 through a predetermined angle.

FIG. 8D shows the path of the slip sheet SS during slip sheet capture. Follower roller 134, forced by spring 121, is in contact with roller 136. This allows roller 136 and 134 to rotate together as best illustrated by FIG. 4. With foot 132 and roller 136 in contact with the slip sheet SS, rotation of roller 136 forces slip sheet SS toward the foot 132 with the foot 132 holding the slip sheet in place. The slip sheet is thus forced upward into the nipped rollers 136, 134 as indicated by path A, in FIG. 8D.

Returning to FIG. 7B in step 744, the pressurized air is optionally provided to the second air bar 362 to minimize adhesion between the slip sheet and the emulsion side of the plate 10. The plate 10 is then advanced by driving the lagging arm nip rollers 314, 316 until the plate header is detected between the first and second leading arm nip rollers 334, 336 by the plate header detector 370. This detection occurs in step 746.

Figure 8E:
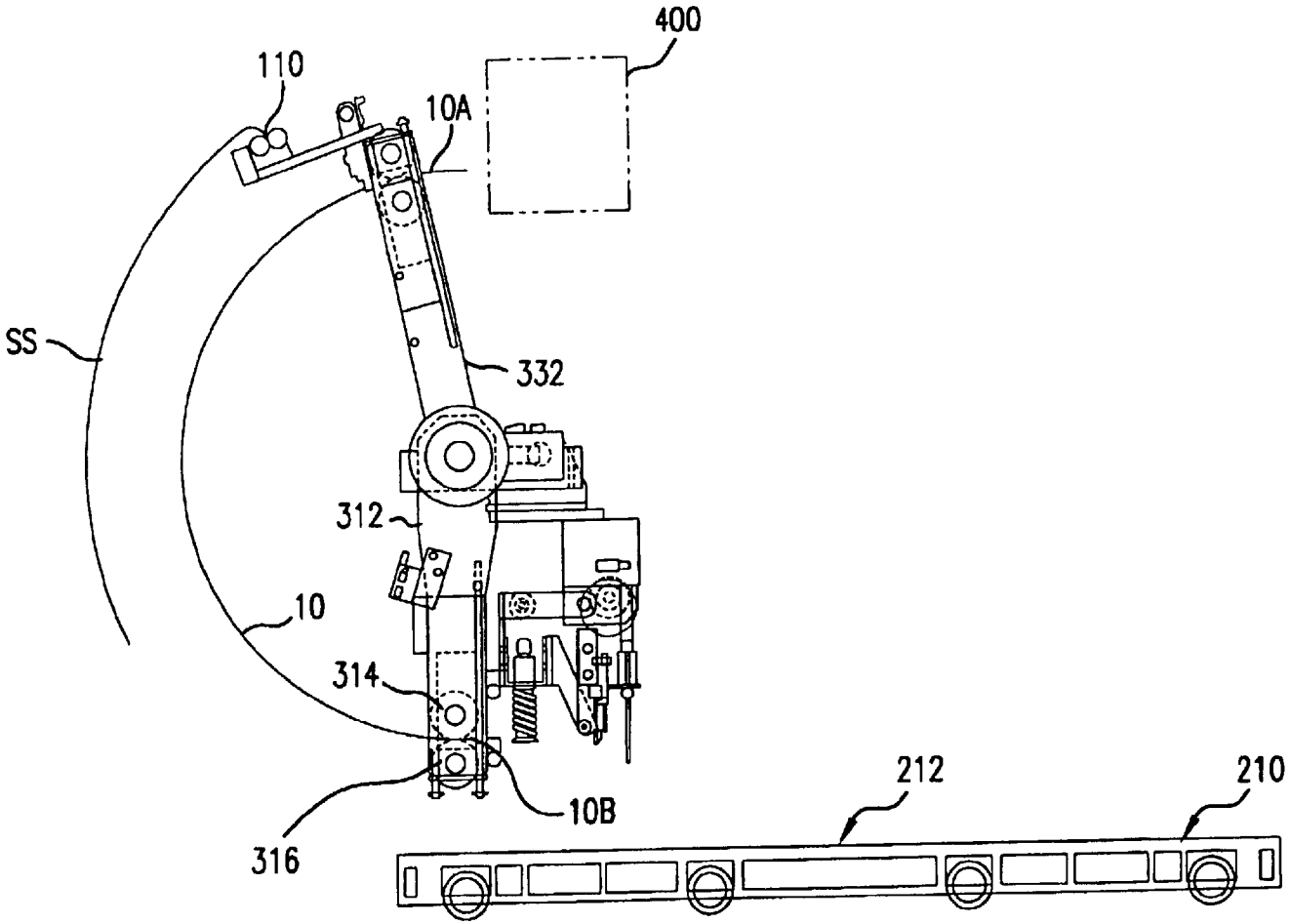

Whether or not the slip sheet SS is captured, the leading arm nip actuation mechanism closes the nip between the leading arm nip rollers 334 and 336 in step 748. So, with plate 10 being held by the plate inverter system 300 and the slip sheet SS being held by the slip sheet capture mechanism 110, the cassette 210 is lowered further by the elevator 214. The leading arms 332 are then rotated to draw the header 110-A of the plate 10 toward the plate transfer system 400, in step 750. In concert, the lagging arm nip rollers 314 and 316 are driven to feed the plate. This is shown in FIG. 8E, where the plate 10 makes an arc through the arcuate transfer path between the leading arms 332 and the lagging arms 312. The slip sheet SS held by the slip sheet capture mechanism 110 covers a similar arc. Of note is the fact that the slip sheet SS and the plate 10 are drawn together off of the stack of plates 212 held in the cassette 210. As a result, the emulsion is preserved and not damaged and the time between picking plate, slip sheet and transporting is reduced, increasing plate throughput.

At a predetermined point in the arc of the leading arms 332, which is determined by encoder counts of motor encoder 344*e* (See FIG. 2), in step 756, the transfer system 400 is configured to receive the plate header 10A. In one example, nip rollers in the transfer system 400 are opened when the leading arms are at 170 degrees.

In step 762, the lagging arm nip rollers 314, 316 continue to rotate, while the leading arms 332 rotate through the arcuate transfer path 310. In one embodiment, the lagging arm nip rollers 314, 316 slightly over-feed the plate 10 to ensure that the plate forms an arc through the arcuate transfer path 310. This prevents any sharp bending or binding of the plate, and prevents the plate from being tugged by the leading arms 332, which could damage the plate's emulsion.

In step 764, the controller 50 determines whether the motor encoder count associated with the lagging arm nip actuation and roller drive mechanism 330 corresponds or is nearly equal to the length of the plate 10. That is, the rollers 314, 316 have almost entirely fed the plate 10. This state is illustrated in FIG. 8E. The plate header 10A is being brought into proximity to the transfer system 400 and the plate tail or trailing end 10B is being held in the nip of lagging arm rollers 314, 316.

At this point, the slip sheet SS is handed off to slip sheet storage, in preferred embodiment. This typically involves its ejection by the slip sheet capture mechanism 110.

Then, in step 766, the lagging arm rollers 314, 316 stop rotating to hold the tail 10B of the plate 10 and the lagging arms 312 rotate through the transfer path 310. In this mode, both the leading arms 332 and the lagging arms 312 are rotating, moving the plate through path 310.

The rotation of arms 312, 332 continues until the leading arms 332 reach the away position at 180 degrees. When this state is determined in step 768, the leads arms 332 stop rotating in step 770. Further, the nip of leading arm rollers 334, 336 is opened. And, the transfer system 400 is configured to feed or draw the plate 10.

Figure 8F:
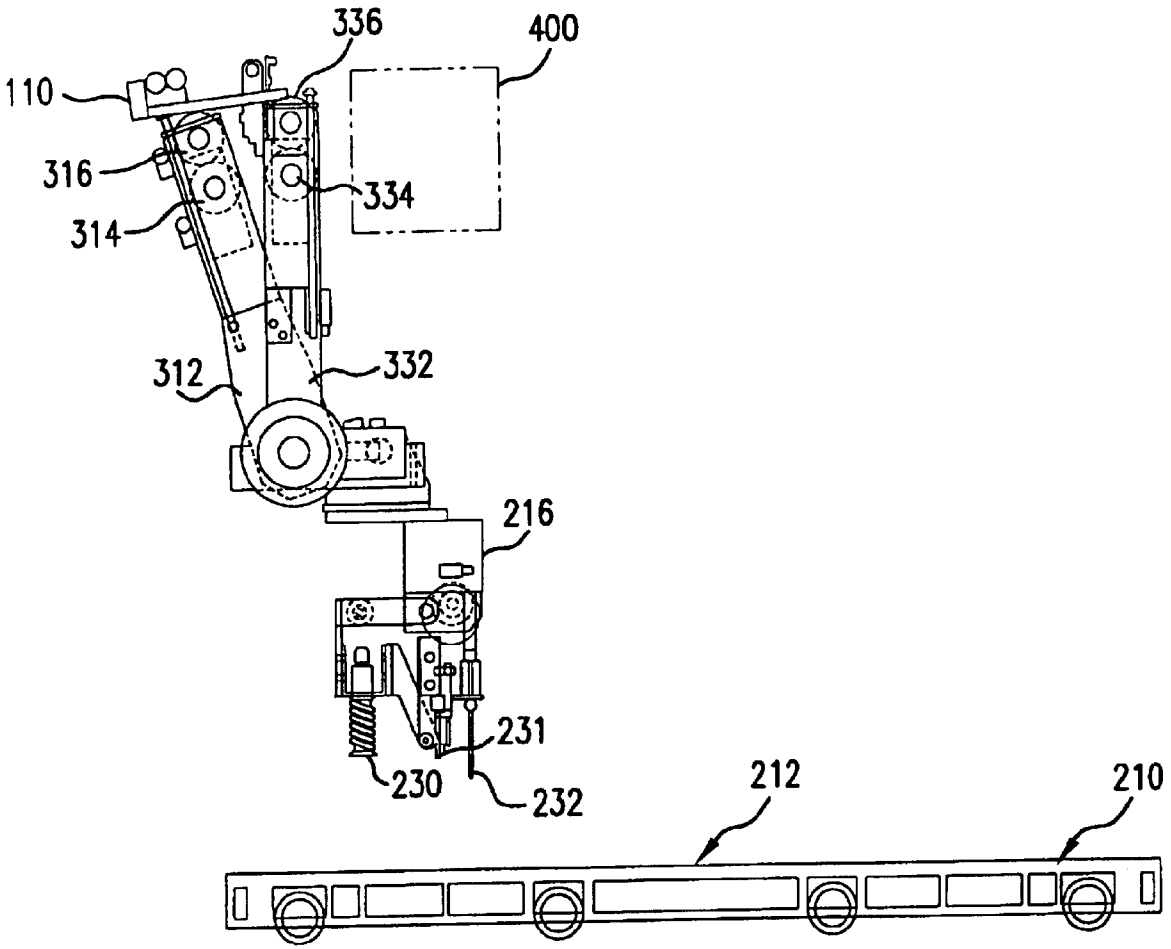

The lagging arms 312 continue to rotate until they reach their away position of 150 degrees. This configuration is illustrated in FIG. 8F. When this state is detected in step 772, the lagging arms 312 stop rotating and the nip of the lagging arm rollers 314, 316 is opened in step 774 completing the hand off of the plate to the transfer system 400.

In one embodiment, a different process is implemented depending on the plate size or length.

To summarize the typical operation, the leading arms carry the leading edge 10A of the plate to the plate transfer system 400. The nip rollers of the lagging arms feed the plate 10 until the lagging edge of the plate 10 is detected or determined to be present, at which time the nip rollers 314, 316 of the lagging arm 312 cease to drive and instead, the lagging arms 312 begin to follow the leading arms 332 through the arcuate transfer path 310.

Thus, through this concerted operation of the leading and lagging arms 332, 312, the plate 10 is inverted from an emulsion side down orientation to an emulsion side up orientation and provided to the plate transfer system 400, so that the plate can be carried to the imaging engine.

It is preferable in this invention to allow the upper nip rollers 314, in contact with the non-emulsion side of the plate to be under motor control for several reasons. First, it is preferred to have direct roller contact rotation on the non-emulsion side of the plate to prevent roller scuffing of the plate emulsion side and second to aid in the introduction of the leading edge of the plate from the peeler.

Figure 9:
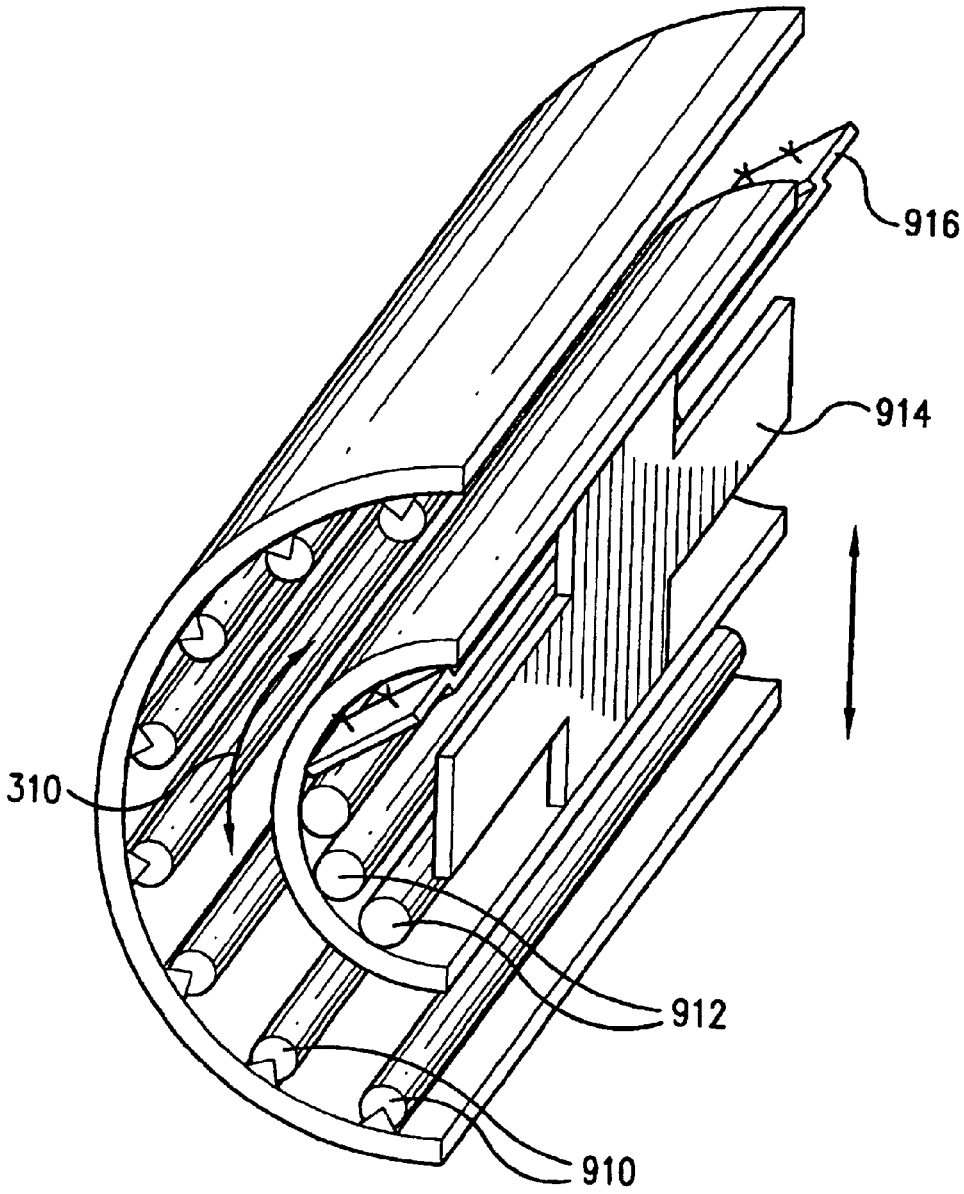
FIG. 9 is a schematic perspective view of a plate inverter system according to another embodiment.

FIG. 9 shows another embodiment of the plate inverter 300. Here two opposed races of rollers 910 and 912 are jumbled to a two-sided arcuate frame 914 that defines the arcuate transfer path 310. The rollers 910 and 912 freely rotate to enable a plate to move along this transfer path 310. The outer race of rollers 910 in combination with the inner race of rollers 912 maintain the radius of the plate while a carrier 916 pulls the plate header through the path 310.

While this invention has been particularly shown and described with references to preferred embodiments thereof, it will be understood by those skilled in the art that various changes in form and details may be made therein without departing from the scope of the invention encompassed by the appended claims.

What is claimed is:

1. A substrate manager, comprising:

a substrate storage system with a stack of substrates;

a substrate picker for picking, substrate, from the stack of substrates;

a substrate inverter system for inverting the substrate, comprising a leading arm and a lagging arm for carrying the substrates over an arcuate transfer path between the substrate storage system and a substrate transfer system; and the substrate transfer system for providing the substrates, after being inverted, to an imaging engine.

2. The substrate manager as claimed in claim 1, wherein the substrate storage system is capable of containing multiple cassette for holding stacks, of substrates.

3. The substrate manager as claimed in claim 1, wherein the substrate picker comprises a substrate peeler for separating a substrate from the stack of substrate.

4. The substrate manager as claimed in claim 3, further comprising a slip sheet separator for ensuring that a slip sheet separated from the substrate that is being picked by the substrate picker.

5. The substrate manager as claimed in claim 1, wherein the leading arm carries a header of the substrates over the arcuate transfer path and the lagging arm carries a trailing edge of the substrates over the arcuate transfer path.

6. The substrate manager as claimed in claim 1, wherein at least one of the leading and lagging arms.

7. A plate inverter for a platesetter system, the plate inverter comprising:

a place picker for picking a plate; and a leading arm and a lagging arm for carrying the plate over an arcuate transfer path between the plate picker and an imaging engine.

8. The plate inverter as claimed in claim 7, wherein the leading arm carries a header of the plate over the arcuate transfer path and the lagging arm carries a trailing edge of the plate over the arcuate transfer path.

9. The plate inverter as claimed in claim 7, wherein the leading arm comprises a first roller and a second roller for both holding the plate and moving the plate relative to the leading arm.

10. A method of managing substrates for a substrate exposure machine, the method comprising:

storing substrates to be exposed in a stack of substrates;

picking the substrates from the stack of substrates;

inverting the substrates by conveying the substrates over an arcuate transfer path by holding headers of the substrates with a leading arm and guiding the headers over the arcuate transfer path; and holding trailing edges of the substrates with a lagging arm and guiding the trailing edges over the arcuate transfer path; and conveying the substrates, after being inverted, to an image engine.

11. The method as claimed in claim 10, wherein the step of storing substrates comprising comprises storing stacks of substrates in cassettes.

12. The method as claimed in claim 10, wherein the step of picking the substrates comprises peeling the substrates to separate the substrates from the stack of substrates.

13. The method of claimed in claim 10, further comprising separating slip sheets from the substrates as the substrates are being picked.

14. The method as claimed in claim 10, further comprising feeding the substrates with rollers on the leading arm after the headers of the substrates have been conveyed over the arcuate transfer path.

15. A printing plate handler for a platesetter system, the plate handler comprising:

an arm including a first nip roller and a second nip roller for closing on a plate and pulling the plate through an arcuate path and then rotating to drive the plate between the first nip roller and the second nip roller.

16. The plate handler as claimed in claim 15, further comprising a second arm including a third nip roller and fourth nip roller for conveying a trailing edge of the plate over the arcuate path.

17. The plate handler as claimed in claim 15, wherein the plate handler receives plates from a plate storage system.

18. The plate handler as claimed in claim 15, wherein the plate handler provides plates to an imaging engine.

* * * * *